United States Patent [19]

Brotherston et al.

[11] 4,407,644

[45] Oct. 4, 1983

[54] FUEL INJECTION PUMPING APPARATUS

[75] Inventors: Colin P. Brotherston, Rainham; Anthony J. Adey, Gravesend, both of England

[73] Assignee: Lucas Industries Limited, Birmingham, England

[21] Appl. No.: 217,465

[22] Filed: Dec. 17, 1980

[30] Foreign Application Priority Data

Jan. 19, 1980 [GB] United Kingdom ..... 8001836

[51] Int. Cl.[3] ..... F04B 19/02

[52] U.S. Cl. ..... 417/462; 417/488

[58] Field of Search ..... 417/462, 488; 222/217, 222/218, 219, 221

[56] References Cited

U.S. PATENT DOCUMENTS

| | | | |
|---|---|---|---|
| 2,406,239 | 8/1946 | Morgenroth | 222/217 |
| 3,883,270 | 5/1975 | Baxter | 417/462 |
| 3,936,233 | 2/1976 | Bonin | 417/462 X |

*Primary Examiner*—Alan Cohan

[57] ABSTRACT

A fuel injection pumping apparatus includes a rotary distributor member having a transverse bore containing a pumping plunger, a single passage is formed in the distributor member and extends from the bore to the periphery of the distributor member, inlet passages and outlets are formed in the body part and break out into the periphery of the distributor member in a common radial plane. The inlet passages and outlets are alternately positioned around the axis of rotation.

3 Claims, 5 Drawing Figures

FUEL INJECTION PUMPING APPARATUS

This invention relates to a fuel injection pumping apparatus for supplying fuel to an internal combustion engine and of the kind comprising a body part, a rotary distributor member mounted in the body part, a bore formed in the distributor member and a plunger therein, a cam for imparting pumping movement to the plunger as the distributor member rotates and means for conveying fuel to and from the bore.

It is known in such apparatus to provide the distributor member with a delivery passage which registers in turn with outlet ports in the body part during successive pumping movements of the plunger and inlet passages which register with an inlet port or ports in the body part to allow fuel to flow to the bore, the delivery and inlet passages can be connected by a single passage to the bore and the delivery and inlet passages are axially spaced relative to the axis of rotation of the distributor member. As a result the length of the distributor member must be such as to provide accommodation for the passages. Moreover, the volume of fuel remaining in the distributor member at the end of the pumping movement of the plunger is considerable being that remaining in the bore and also that contained in the passages in the distributor member. It is desirable that the volume of fuel should be as small as possible.

The object of the present invention is to provide an apparatus of the kind specified in a simple and convenient form.

According to the invention in an apparatus of the kind specified said means for conveying fuel comprises a single passage extending to the periphery of the distributor member and communicating with said bore, a plurality of outlet ports in the body part and with which said passage can register in turn as the distributor member rotates during successive pumping movements of the pumping plunger and a plurality of inlet ports alternately arranged with said outlet ports, said inlet ports being in communication with a source of fuel.

Figure 1:
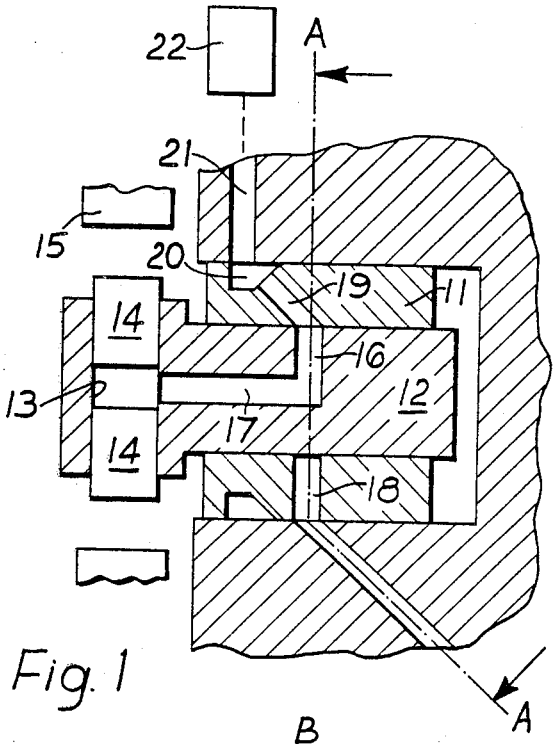
Figure 2:
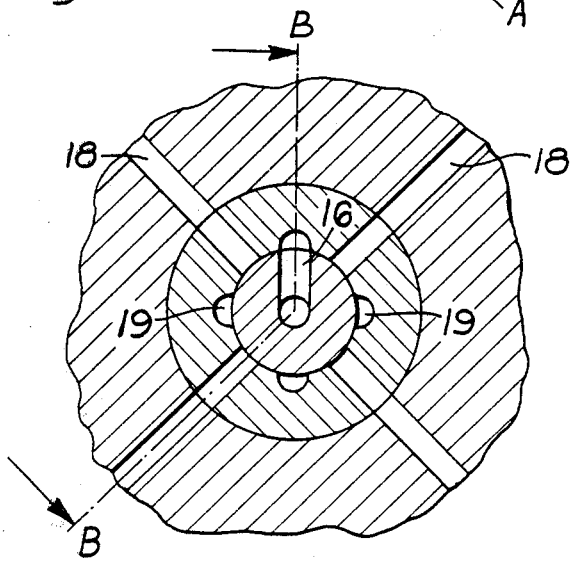
Figure 3:
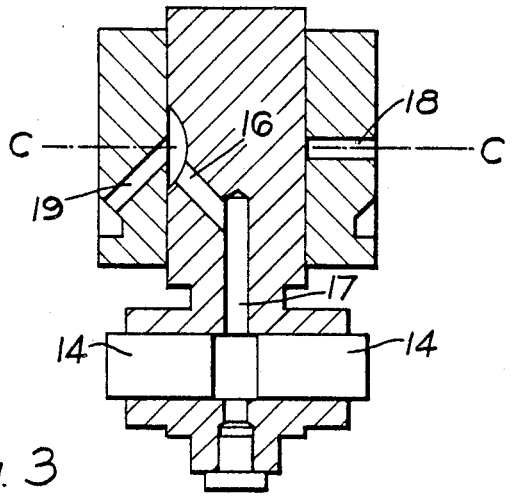
Figure 4:
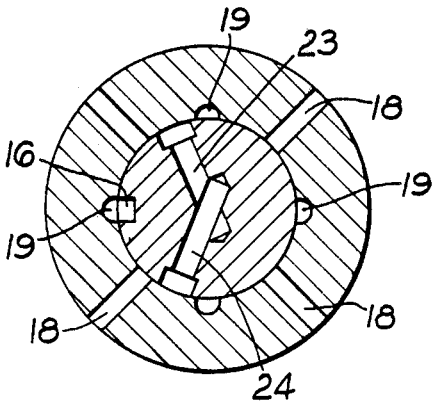
Figure 5:
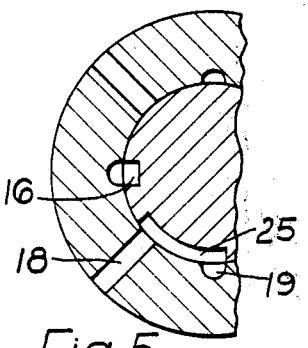

One example of a pumping apparatus in accordance with the invention will now be described with reference to the accompanying drawings in which:

FIG. 1 is a diagrammatic sectional side elevation of the apparatus taken on the line B—B of FIG. 2, FIG. 2 is a section along the line A—A of FIG. 1, FIG. 3 is a view similar to FIG. 1 showing a modification, FIG. 4 is a cross section on the line C—C of FIG. 3, and FIG. 5 shows a further modification.

Referring to the drawings the apparatus comprises a body part 10 in which is located a sleeve 11 which supports a rotary distributor member 12. The distributor member is adapted to be driven in timed relationship with the associated engine.

A portion of the distributor member extends from the sleeve 11 and is of enlarged diameter and formed in this portion of the distributor member is a transversely extending bore 13 in which is mounted a pair of pumping plungers 14. An annular cam ring 15 surrounds the distributor member and has a plurality of inwardly extending cam lobes, the number of cam lobes being equal to the number of cylinders of the associated engine. In known manner, the outer ends of the plungers 14 are engaged by shoes which support rollers, the rollers engaging with the internal surface of the cam ring.

The bore 13 communicates with a radially disposed passage 16, by way of a longitudinal passage 17. Moreover, formed in the sleeve and extending through the body part, are outlet ports 18 which in use, are connected to the injection nozzles respectively of the associated engine. The portions of the outlet ports 18 in the sleeve 11, lie in a common radial plane as seen in FIG. 1. The communication of the passage 16 with an outlet 18 occurs slightly before the plungers 14 can be moved inwardly by the cam lobes.

The sleeve 11 also has a plurality of inlet passages 19 formed therein and these extend to the internal peripheral surface of the sleeve and break-out in the aforesaid plane. The inlet passages are alternately disposed relative to the outlets 18. The passage 16 communicates with an inlet 19 during at least part of the time when the plungers are permitted to move outwardly by the cam lobes. The outer ends of the inlet passages are connected to a circumferential groove 20 and this by way of a passage 21, is connected to a source of fuel indicated at 22. This may comprise a pump the rotary part of which is driven in known manner from the distributor member. Moreover, a fuel control device is provided to control the amount of fuel supplied through a passage 19 when the passage 16 is in register therewith.

The fuel control device may comprise a simple throttle, a more complex arrangement including a metering shuttle or an adjustable stop for limiting the outward movement of the plungers.

The operation of the apparatus is exactly the same as conventional forms of rotary distributor pumping apparatus with the exception that the single passage 16 conveys fuel to and from the bore 13. As shown in the drawings fuel is being supplied to the bore 13 and the plungers 14 will be moving outwardly. As the distributor member rotates the passage 16 will move out of register with the inlet passage 19 and into register with an outlet 18. Whilst the passage 16 is in register with an outlet 18 the plungers will be moved inwardly and fuel will be displaced to the respective injection nozzle of the engine.

The distributor member is appreciably shorter than with the known forms of apparatus and furthermore, the volume of fuel contained in the distributor member at the end of the delivery of fuel will be less in view of the fact that the longitudinal passage 17 is shorter and there are no separate inlet passages and delivery passage.

The apparatus illustrated is for providing fuel to a four cylinder engine. A similar arrangement may, however, be utilised for providing fuel to an engine having more or less cylinders.

In the arrangement shown in FIGS. 3 and 4 the passage 16 is inclined to the axis of rotation of the distributor member. This results in a reduction in the volume of fuel in the passages in the distributor member but it also creates space for a pair of radial interconnected drillings 23, 24. These drillings are positioned at their outer ends so that they can establish communication between an outlet port 18 and an inlet 19. This communication takes place after the outlet port has received fuel from the pumping space defined by the plungers and it acts to bring the pressure in the outlet ports 18 to a low constant value.

Instead of the interconnected drillings 23, 24 a part circumferential groove 25 may be provided as shown in FIG. 5. In this case the distributor member is rotating in the clockwise direction but if desired a further groove 25 may be provided on the other side of the passage 16 so that the direction of rotation of the distributor member does not matter. If desired the grooves 25 may extend around the distributor member so that they join up with each other.

We claim:

1. A fuel injection pumping apparatus for supplying fuel to an internal combustion engine and comprising a body part, a rotary distributor member mounted in the body part, a bore formed in the distributor member and a plunger therein, a cam for imparting inward movement to the plunger as the distributor member rotates, and means for conveying fuel to and from said bore, said means comprising a single passage communicating with said bore and including an axially extending portion and an inclined portion extending at an angle to the axis of rotation of the distributor member and breaking out onto the periphery of the distributor member, a plurality of outlet ports in the body part and with which said passage can register in turn as the distributor member rotates during successive pumping movements of the pumping plunger, a plurality of inlet ports alternatively arranged with said outlet ports, said inlet ports being in communication with a source of fuel, and a pair of interconnected drillings in the distributor member, said drillings extending to the periphery of the distributor member and being positioned to register with an inlet port and an outlet port after said outlet port has been supplied with fuel.

2. A fuel injection pumping apparatus for supplying fuel to an internal combustion engine and comprising a body part, a rotary distributor member mounted in the body part, a bore formed in the distributor member and a plunger therein, a cam for imparting inward movement to the plunger as the distributor member rotates and means for conveying fuel to and from said bore, said means comprising a single passage extending to the periphery of the distributor member and communicating with said bore, a plurality of outlet ports in the body part and with which said passage can register in turn as the distributor member rotates during successive pumping movements of the pumping plunger, a plurality of inlet ports alternately arranged with said outlet ports, said inlet ports being in communication with a source of fuel and a part circumferential groove on the distributor member, said groove acting to place an outlet sometime after it has received fuel in communication with an inlet.

3. An apparatus according to claim 2 in which said groove extends around the distributor member by an amount such that during the time fuel is being supplied to said outlet all the other outlets are in communication with an inlet.

* * * * *